United States Patent [19]

Bracewell

[11] Patent Number: 4,803,194

[45] Date of Patent: Feb. 7, 1989

[54] THERMAL TRANSFER PRINTING PAPER

[75] Inventor: Robert G. Bracewell, Canterbury, United Kingdom

[73] Assignee: The Wiggins Teape Group Limited, Basingstoke, England

[21] Appl. No.: 909,267

[22] Filed: Sep. 19, 1986

[30] Foreign Application Priority Data

Sep. 19, 1985 [GB] United Kingdom ..... 8523179

[51] Int. Cl.[4] ..... B41M 5/035; B41M 5/26

[52] U.S. Cl. ..... 503/227; 8/471; 428/211; 428/513; 428/535; 428/537.5; 428/913; 428/914

[58] Field of Search ..... 8/471; 346/200; 428/211, 341, 342, 511–513, 535, 537.5, 913, 914; 503/227

[56] References Cited

U.S. PATENT DOCUMENTS

| | | | |
|---|---|---|---|
| 4,057,662 | 11/1977 | Johnson et al. | 427/209 |
| 4,490,732 | 12/1984 | Maekawa et al. | 346/200 |
| 4,505,975 | 3/1985 | Majima | 8/471 |
| 4,615,938 | 10/1986 | Hotta et al. | 8/471 |

FOREIGN PATENT DOCUMENTS

| | | | |
|---|---|---|---|
| 0059889 | 4/1983 | Japan | 346/200 |
| 59-187887 | 10/1984 | Japan | 503/227 |
| 59-187891 | 10/1984 | Japan | 503/227 |
| 59-187892 | 10/1984 | Japan | 503/227 |
| 59-064393 | 12/1984 | Japan | 503/227 |
| 60-038192 | 2/1985 | Japan | 503/227 |
| 1118725 | 7/1968 | United Kingdom | 428/500 |
| 1139896 | 1/1969 | United Kingdom | 430/227 |
| 2106148 | 7/1983 | United Kingdom | 503/227 |

OTHER PUBLICATIONS

Patent Abstracts of Japan, vol. 9, No. 164 (M-395) (1887), Jul. 10, 1985 Kanzaki Seishi K. K.

Patent Abstracts of Japan, vol. 9, No. 70 (M-367) (1793), Mar. 30, 1985, Shigehiko Miyamoto (with translation).

"Thermal Transfer Printing: New Technology and New Uses", Business Forms & Systems, May 1983, pp. 12–13,68.

*Primary Examiner*—Bruce H. Hess

*Attorney, Agent, or Firm*—Burns, Doane, Swecker & Mathis

[57] ABSTRACT

Thermal transfer printing paper of improved print performance carries a dried polyethylene emulsion, optionally mixed with an adhesive material such as cooked or solubilized starch. The polyethylene content may be 0.2 to 0.4% on a dry basis. The emulsion may be applied at the size press or size bath of the paper machine used to make paper.

7 Claims, No Drawings

THERMAL TRANSFER PRINTING PAPER

This invention relates to thermal transfer printing paper, i.e. paper for receiving thermal transfer prints, and to the production of such paper.

Thermal transfer printing is a process in which imaging material is selectively transferred in image configuration from a donor to an adjacent receptor by the application of heat to the donor. The imaging material may be, for example, a coloured pigment or dye incorporated in a wax or other carrier which is physically transferred from the donor to the adjacent receptor. Alternatively, the imaging material may be a dye which sublimes when heated and is thereby transferred to the adjacent receptor. The donor is normally a ribbon of paper or plastics film which carries the imaging material as a coating, or a ribbon which is impregnated with imaging material. The receptor is normally a web or sheet of paper or plastics film, (although numerous other materials may be imaged by the thermal transfer printing process, for example textiles and metal). The heating means used to bring about thermal transfer is typically a thermal printing head including an array of heated styli or dot elements. Further information on thermal transfer printing may be found in an article entitled "Thermal Transfer Printing: New Technology And New Uses" by Edward Webster "Business Forms & Systems", May, 1983.

Thermal transfer printing paper should not be confused with thermal paper, which is paper which carries image-forming constituents in latent heat-activatable form on its surface and which may also be imaged by means of a thermal printing head. Print information on thermal paper does not involve any transfer of imaging material from a donor to a receptor, since all the materials necessary to produce the print are present on a single sheet of paper. Thermal paper may however by used as the donor in a thermal transfer printing system if the surface of the thermal paper opposite to that which carries the thermal coating carries a thermal transfer coating. Such an arrangement enables two copies of an image to be produced, in that when heat is applied to the thermal paper, an image is produced on the thermal paper by activation of the latent image-forming constituents, and on a suitable adjacent receptor by thermal transfer.

The thermal transfer printing papers used hitherto have generally been sized papers loaded with a filler such as kaolin, calcium carbonate or talc and calendered to provide a smooth surface, which has been found to be highly desirable for the attainment of good image transfer and hence good print formation. Whilst such papers have proved acceptable, there is scope for improvement in their image transfer characteristics, particularly with certain of the many types of thermal transfer printers which are available (these utilise a variety of different donors, imaging materials and transfer mechanisms, and so the performance of a particular paper can vary considerably when used with different types of thermal transfer printer).

It has now been found that improved print performance, for example a more dense image, can be obtained with a variety of thermal printers if the thermal transfer printing paper carries the dried residue of a polyethylene emulsion, especially if cooked or solubilized starch is also present.

Accordingly, the present invention provides in a first aspect thermal transfer printing paper carrying a dried polyethylene emulsion.

In a second aspect, the present invention provides a process for the production of thermal transfer printing paper, comprising the steps of applying a polyethylene emulsion to a paper web and subsequently drying the web.

In a third aspect, the present invention provides a thermal transfer printing process in which imaging material is selectively transferred in image configuration from a donor to an adjacent receptor paper by the application of heat to the donor, wherein the receptor paper carries a dried polyethylene emulsion.

The polyethylene emulsion may conveniently be applied to the paper by means of a size press or size bath on the machine used to make the paper, but other on- or off-machine coating techniques could alternatively be used.

In a preferred embodiment of the invention, the polyethylene emulsion is mixed with cooked or solubilized starch. The starch serves primarily to glue down loose fibres which might otherwise project from the paper web and impair printing performance. Other adhesive materials, for example gelatin, may be used instead of or together with the starch.

The thermal transfer paper may be generally conventional, i.e of the type used hitherto and described above. Thus it may contain talc or other conventional loadings, and may be conventionally sized, for example with an alkyl ketene dimer sizing agent. The grammage of the paper may vary in dependence on the requirements of the user or of the thermal transfer printer being employed. A grammage of the order of 65 to 75 g $m^{-2}$ (before application of the polyolefin emulsion) is likely to be suitable for most purposes. The paper may be formed, for example, from pulp beaten to a wetness of about 35° to 40° Schopper-Riegler. After the application and drying of the polyolefin emulsion, the web is desirably calendered to provide a smooth finish.

The concentration of polyethylene (i.e. polyethylene solids) in the size mix is suitably in the range of about 0.5% to 2% by weight. The starch content of the size mix (when starch is present) may be, for example, of the order of 6 to 7% by weight.

The polyethylene content in the finished product may, for example, be in the range 0.2 to 0.4% by weight on a dry basis.

Emulsions of polyolefins other than polyethylene do not appear to be readily commercially available, but in principle, they ought to be equivalent to polyethylene, and hence to work.

The invention will now be illustrated by the following Examples:

EXAMPLE 1

50 kg of oxidised potato starch ("Amylox P45" supplied by Tunnel Avebe, of Rainham, Kent, United Kingdom) were cooked with water in a starch mixing tank and the cooked starch solution was diluted to a volume of 680 liters to give a stock starch solution. A 25% solids content oxidised polyethylene emulsion ("Mystolube TR" supplied by Catomance Ltd., of Welwyn Garden City, United Kingdom) was then added to portions of the starch solution in amounts of 2.5%, 5% and 7.5% v/v. The 2.5% and 5% mixtures were then applied to papers of nominal grammage 68 g $m^{-2}$ and 75 g $m^{-2}$ respectively by means of a size bath on the papermachine used to produce the papers. The 7.5% mixture was applied only to the 75 g $m^{-2}$ paper.

The papers were each formed from a hardwood furnish beaten to a wetness of about 35° Schopper-Riegler. A conventional alkyl ketene dimer sizing composition ("Aquapel 360" size together with "Kymene 557" resin both supplied by Hercules) was employed in the furnish. Cationic starch and a talc loading in nominal amounts of 2.8% and 7% by weight respectively were also present. A 68 g $m^{-2}$ control paper was also produced from this furnish but no polyethylene emulsion was used in the size bath in this case (i.e. only starch was applied at the size bath). The control paper was produced immediately before the paper according to the invention, so that a certain amount of the previous size composition remained in the size bath when the polyethylene-containing mixtures were introduced. Some dilution was therefore inevitable. Similar factors applied when the size bath mixtures were changed. Consequently the size bath compositions actually applied did not correspond exactly to that of the mixtures made up as described above (though the difference was small). The size bath pick up was thought in each case to be of the order of 30% by weight, based on the weight of the paper, and the paper was later found to contain of the order of 0.2 to 0.4% by weight polyethylene, based on the dry weight of the paper.

The resulting papers were each imaged using two different thermal transfer typewriters ("Canon Typemate 10" and "Brother EP22" typewriters) and two different thermal transfer printers designed for printing out from a computer ("Okimate 20" and "Epson P80" printers).

The prints were assessed by paired comparison techniques using six assessors. It was concluded that the papers carrying polyethylene emulsion were in all cases superior to the control paper. In some cases the paper produced from the 5% v/v polyethylene emulsion addition gave superior performance to that from the 2.5% addition, but in other cases, the reverse was true. There seemed to be little to gain from use of the higher (7.5%) emulsion addition level.

EXAMPLE 2

This illustrates the effect of using cooked or solubilized starch in conjunction with polyethylene emulsion.

The polyethylene emulsion used was "Mystolube TR", as in Example 1, and this was diluted from 25% solids content as supplied to 5% solids content to form a first coating composition containing no starch. A second coating composition containing polyethylene emulsion ("Mystolube TR") and oxidised potato starch ("Amylox P45") was also made up, the weight ratio of polyethylene emulsion: starch solution being 1:2 and the concentrations being 10% for the polyethylene emulsion (based on the 25% solids content of emulsion as supplied) and 7.5% for the starch solution.

The two coating compositions were separately applied to a starch-free high kraft fibre content wet beaten base paper of nominal grammage 105 g $m^{-2}$ using a laboratory size press coater to give a wet pick-up of about 15 g $m^{-2}$ (corresponding to dry pick-ups of about 0.2 g and 0.9 g for polyethylene alone and polyethylene/starch respectively).

After drying, the papers obtained, and untreated base paper as a control, were evaluated on three different thermal transfer printers (the "Okimate 20" and "Epson P80" printers as used in Example 1, and a "Canon Typemate 10" thermal typewriter printer). It was noted that the paper treated with polyethylene emulsion without starch gave a significantly greater image density than the control paper, and that the paper treated with starch as well as polyethylene emulsion was better still.

EXAMPLE 3

This illustrates the use of a different commercially-available polyethylene emulsion from that used in the previous Examples. This polyethylene emulsion which will be referred to hereafter as polyethylene emulsion II, was that supplied as "Mystolube OP" by Catomance Ltd., and is a plasticized polyethylene supplied at 25% solids content and a pH of about 8.

A 7.5% solids content solution of oxidised potato starch ("Amylox P45") was prepared by a method generally as described in Example 1 (but using smaller quantities of material). Polyethylene emulsion II was then added at four different addition levels to give compositions containing 0.125%, 0.25%, 0.375% and 0.5% polyethylene on a dry weight basis. These compositions were then each coated on to a base paper as described in Example 2 using a laboratory size press coater in the manner described in Example 2.

In order to provide a standard of comparison, equivalent compositions were made up using the polyethylene emulsion used in the previous Examples ("polyethylene emulsion I"), and which had been shown to give rise to a thermal transfer printing paper of improved performance.

In order to demonstrate the effect of the polyethylene emulsion, as opposed to that of the oxidised starch, a control paper was prepared using the starch solution with no addition of polyethylene emulsion.

After drying, all the papers obtained were evaluated on the three thermal transfer printers used in the Example 2 evaluation. It was noted that all the papers which had been treated with polyethylene emulsion gave significantly greater image density than the paper treated with starch only. Whilst polyethylene emulsion II produced an improvement in image density, this was not quite as great as that achieved with the polyethylene emulsion I.

EXAMPLE 4

This illustrates the use of a further range of commercially available polyethylene emulsions, namely:

Polyethylene emulsion III - an oxidised polyethylene emulsified in water with a non-ionic surfactant. The polyethylene used had a softening point of 137° C. and a hardness, as measured by the ASTM D-5 penetration method, of less than 0.5 dm.m. The emulsion as supplied had a total solids content of 36%, and a polyethylene solids content of 27%. The trade name of the emulsion was "Emrel 2", and the supplier was Hickson and Welch Limited, of Castleford, West Yorkshire, Great Britain.

Polyethylene emulsion IV - also an oxidised polyethylene emulsified in water with a non-ionic surfactant, but in this case the polyethylene had a softening point of 104°-105° C. (as measured by the ASTM E-28 method) and a hardness, (as measured by the ASTM D-5 penetration method of 5.5 dm.m). The emulsion as supplied had a pH of 8.3, a total solids content of 25% and a polyethylene solids content of 20%. The mean particle size of the polyethylene was less than 8 microns. The trade name of the emulsion was "Bradsyn PE", and the supplier was Hickson & Welch Limited.

Polyethylene emulsion V - as polyethylene emulsion IV, except that the emulsion had a pH of 6.3, the total solids content was 40%, the polyethylene solids content was 32%, the mean particle size was 8 microns, the surfactant used with cationic rather than non-ionic, and the trade name was "Bradsyn UC 40%".

Polyethylene emulsion VI - as polyethylene emulsion IV, except that the total solids content was 40%, the polyethylene solids content was 35%, and the trade name was "Bradsyn U".

Polyethylene emulsion VII - a high molecular weight non-oxidised non-ionic polyethylene wax emulsion supplied at 40–41% solids content under the trade name "Poly-EM 40" by Rohm & Haas. The mean particle size is less than 0.1 micron. The solid polyethylene has a density of 0.92 g $cm^{-3}$, a melting point of 109° C., and an apparent average molecular weight, as derived from an inherent viscosity determination, of 18,000.

A 7.5% solids content solution of oxidised potato starch ("Amylox P45") was prepared by a method generally as described in Example 1 (but using smaller quantities of material). Each of polyethylene emulsion III to VII were added to respective 100 ml aliquots of the starch solution in amounts such as to provide 0.5 g and 1.25 g additional solids. This procedure was also carried out using polyethylene emulsion I for comparison purposes. The compositions were then each coated on to a base paper as described in Example 2 using a laboratory size press coater also as described in Example 2.

After drying, all the papers obtained, and the untreated base paper, were evaluated using "Okimate 20" and "Epson P80" thermal printers. The "Okimate 20" evaluation was in two parts, one with a primary colour block print and the other with alphanumeric characters. The prints were assessed by six assessors using a ranking technique.

All the papers treated with polyethylene emulsion were superior to the untreated base paper. The paper treated with polyethylene emulsion I gave the best print quality with the colour block print, closely followed by polyethylene emulsion III. The other papers were less good, though still much improved compared with the untreated paper. For coloured alphanumeric characters polyethylene emulsions I and III were equivalent, and for monochrome alphanumeric characters (on the Epson P80 printer) polyethylene emulsion III was superior to polyethylene emulsion I at the higher concentration level. The remaining emulsions were less good, though still much improved compared with the untreated paper.

While this invention has been described in terms of various preferred embodiments, the skilled artisan will appreciate that various modifications, substitutions, omissions, and changes may be made without department from the spirit thereof. Accordingly, it is intended that the scope of the present invention be limited solely by the scope of the following claims, including equivalents thereof.

What is claimed is:

1. A thermal system including a dye donor ribbon and a thermal transfer printing paper comprising a substrate having a receiving layer for receiving imaging material thermally transferred from the donor ribbon, said receiving layer consisting essentially of a dried polyethylene emulsion, said polyethylene being the only synthetic resin in said receiving layer.

2. A thermal transfer system as claimed in claim 1, wherein said coating has a polyethylene content of from about 0.2 to about 0.4% by weight on a dry basis.

3. A thermal transfer system as claimed in claim 1, wherein said substrate comprises paper derived from pulp beaten to a wetness of 35° to 40° Schopper-Riegler and having a grammage of 65 to 75 g $m^{-2}$.

4. A thermal transfer system including a dye donor ribbon and thermal transfer printing paper comprising a substrate having a receiving layer for receiving imaging material thermally transferred from the donor ribbon, said receiving layer consisting essentially of a dried polyethylene emulsion and an adhesive material, said polyethylene being the only synthetic resin in said receiving layer.

5. A thermal transfer system as claimed in claim 4, wherein said coating has a polyethylene content of from about 0.2 to about 0.4% by weight of a dry basis.

6. A thermal transfer system as claimed in claim 4, wherein said substrate comprises paper derived from pulp beaten to a wetness of 35° to 40° Schopper-Riegler and having a grammage of 65 to 75 g $m^{-2}$.

7. A thermal transfer system as claimed in claim 4, wherein said adhesive material consists essentially of cooked or solubilized starch.

* * * * *